US005890975A

United States Patent [19]

Stiefel

[11] Patent Number: 5,890,975

[45] Date of Patent: Apr. 6, 1999

[54] GOLF BALL AND METHOD OF FORMING DIMPLES THEREON

[75] Inventor: Joseph F. Stiefel, Ludlow, Mass.

[73] Assignee: Lisco, Inc., Tampa, Fla.

[21] Appl. No.: 869,981

[22] Filed: Jun. 5, 1997

[51] Int. Cl.[6] ..... A63B 37/14

[52] U.S. Cl. ..... 473/384

[58] Field of Search ..... 473/384, 383

[56] References Cited

U.S. PATENT DOCUMENTS

| | | | |
|---|---|---|---|
| D. 319,676 | 9/1991 | Ihara | D21/205 |
| 3,831,423 | 8/1974 | Brown et al. | 72/358 |
| 4,869,512 | 9/1989 | Nomura et al. | 473/384 |
| 5,200,573 | 4/1993 | Blood | 473/384 X |
| 5,308,076 | 5/1994 | Sun | 473/384 |
| 5,356,150 | 10/1994 | Lavallee et al. | 473/384 X |
| 5,377,989 | 1/1995 | Machin | 473/384 |
| 5,406,043 | 4/1995 | Banji | 219/69.17 |

*Primary Examiner*—George J. Marlo
*Attorney, Agent, or Firm*—Laubscher & Laubscher

[57] ABSTRACT

A spherical ball and a method of making the spherical ball wherein the ball has a plurality of elongated dimples substantially covering the outer surface of the ball without any dimple overlap. The elongated dimples are of at least two types including a first plurality of dimples having a minor axis and a major axis which together form the long axis of the first plurality of dimples the minor axis being less than the major axis. A second plurality of dimples has a minor axis equal to that of the first plurality of dimples and a major axis less than the major axis of the first plurality of dimples but greater than the minor axis.

8 Claims, 5 Drawing Sheets

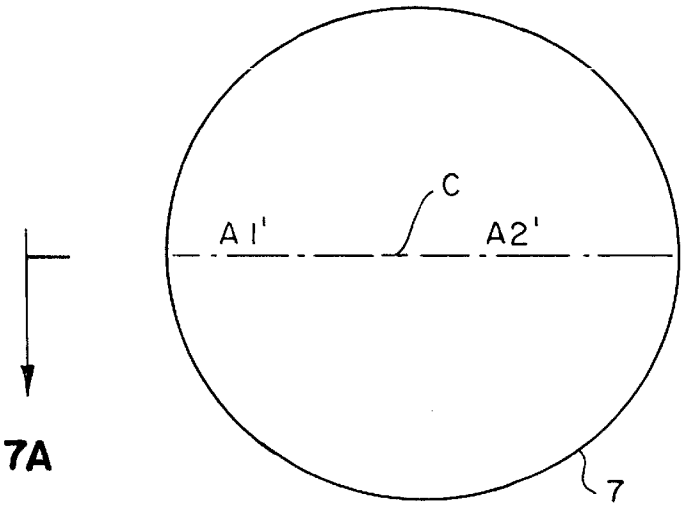
FIG. 7
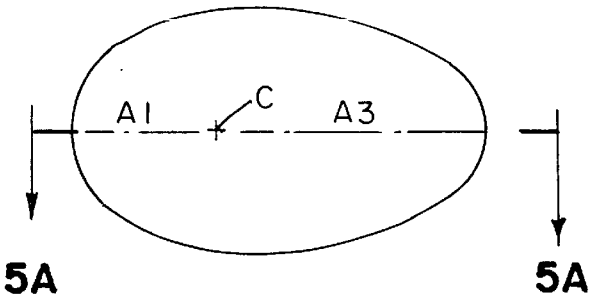
FIG. 5
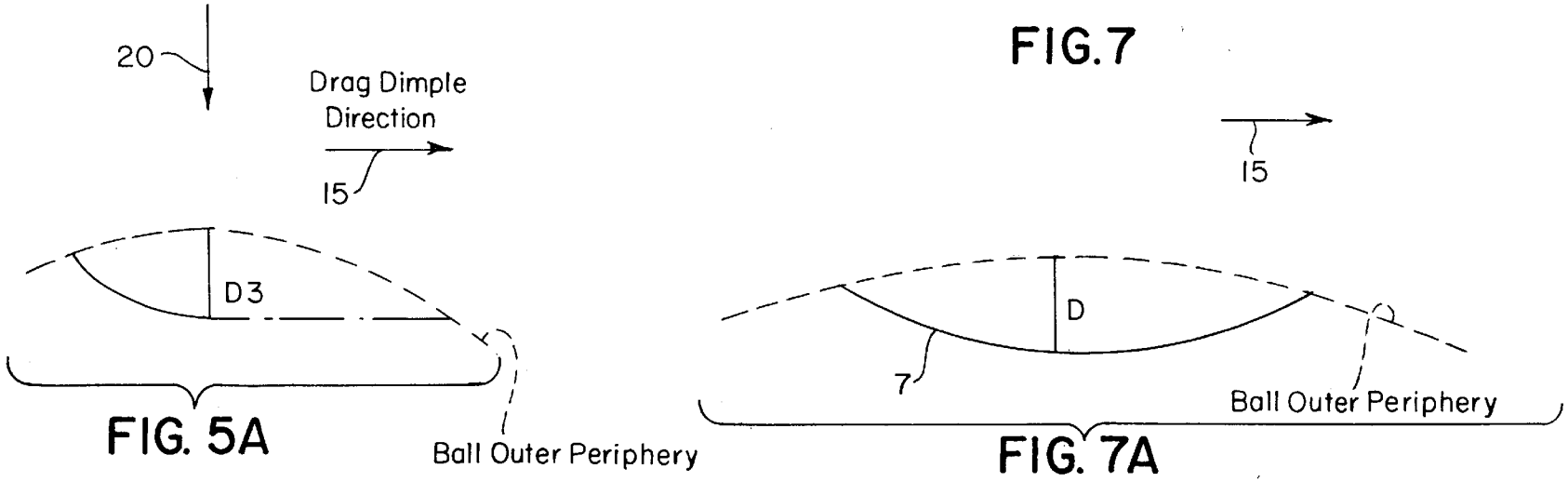
FIG. 7A
FIG. 5A

GOLF BALL AND METHOD OF FORMING DIMPLES THEREON

This invention relates generally to the dimple configuration on the surface of a golf ball and more particularly to an elongated dimple configuration and the method of obtaining that configuration.

BACKGROUND OF THE INVENTION

Golf balls are now being produced having various dimple patterns, dimple sizes, and geometric dimple patterns. Generally speaking, all of these dimples are configured so as to have a substantially constant geometric surface. Whether circular or multi-sided, the dimples are designed so that the geometrical configuration of each dimple is substantially the same regardless of its size. In this type of dimple arrangement, the dimples are normally configured in some pattern such as an octahedron, dodecahedron, or the like, or are configured so as to provide sections within the hemisphere, whether those sections number four, or six, or whatever desired configuration. Normally, the dimples are arranged in a desired pattern within each section and then this pattern is repeated for each section. The standard procedure is that each hemisphere has the same number of dimples and in substantially the same pattern and the hemispheres may be rotated with respect to each other depending upon the position of the mold halves.

U.S. Pat. No. 5,356,150 issued Oct. 18, 1994 and assigned to the assignee of the present invention discloses a golf ball having a plurality of dimples formed on the spherical surface of the golf ball, with the surface defining opposite poles and an equator midway between the poles so as to divide the surface into two hemispheres. The hemispheres have substantially the same dimple pattern and each dimple pattern comprises a dimple-free area surrounding the pole, a dimple-free area adjacent the equator, and a plurality of substantially identical sections extending between the pole and the equator, with each of said sections having a dimple pattern which comprises a plurality of elongated dimples. The axis of each dimple may extend in a direction between a line parallel with the equator and a line between the equator and the pole. The majority of the dimples overlap at least one adjacent dimple. The method used for obtaining this pattern is to locate a plurality of substantially similar geometric dimples on each of the hemispheres and move the outline of the dimples tangentially along the surface of the ball in the selected direction until it passes beyond the spherical surface so as to form elongated dimples in the surface of the ball.

SUMMARY OF THE INVENTION

The present invention is an improvement over the ball disclosed in U.S. Pat. No. 5,356,150 in that it improves the aerodynamics of that ball. It has been found that the use of a dimpled surface where substantially all of the dimples overlap does not necessarily have the optimum aerodynamic characteristics during the flight of the ball. The present invention may be formed by the basic movement as set forth in the above-described patent and uses at least two different sizes of elongated dimples with substantially no dimple overlap. In order to obtain substantially maximum dimple coverage of the surface of the ball a first set of dimples are provided which are formed by extending the dimple depression in a selected direction which may extend until it terminates as it leaves the surface of the ball. For the purposes of clarification, this movement will be referred to as full dimple drag. A second set of dimples are provided by using a dimple drag less than the full distance described above which will be referred to as partial dimple drag. This second set of elongated dimples permit the use of shorter elongated dimples which provides a substantial dimple coverage with substantially no dimple overlap. Additional elongated dimples may be added using dimple depressions of differing diameters and depths. Further, a pattern may include dimples having different partial drag lengths.

BRIEF DESCRIPTION OF THE DRAWINGS

FIGS. 5 & 5A show a plan and cross-sectional view of an elongated dimple formed by having a full dimple drag;

FIGS. 7 and 7A show a plan and cross-sectional view of a further elongated dimple formed by having a partial dimple drag;

DETAILED DESCRIPTION OF THE PREFERRED EMBODIMENT

Figure 1:
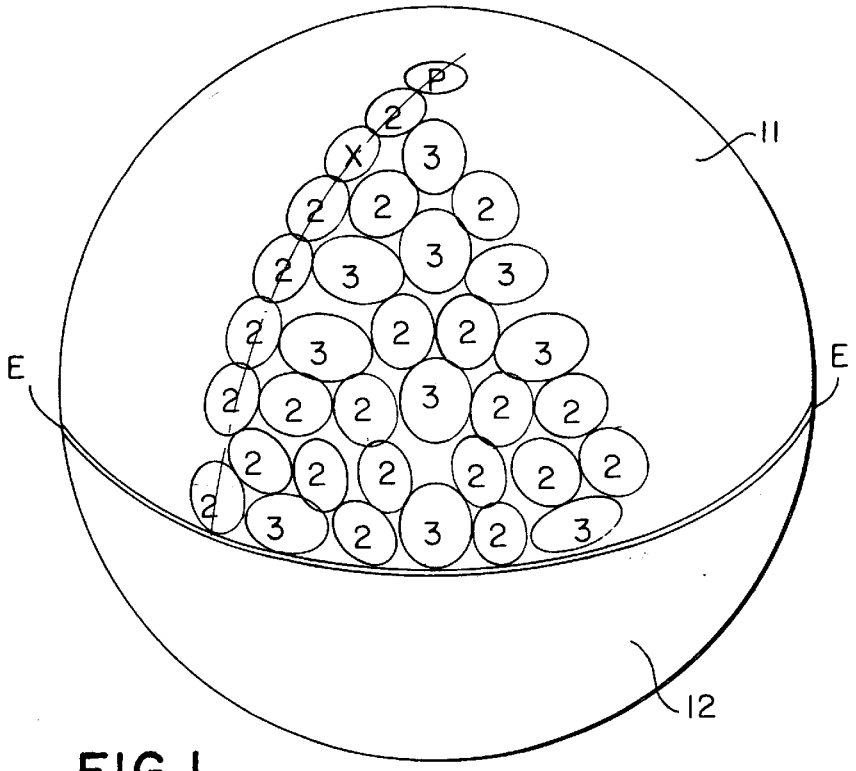
FIG. 1 is a perspective off-equator view showing a basic dimple pattern section which is repeated about the surface of the ball in each hemisphere.

FIG. 1 shows the basic pattern used to develop the dimple coverage in one example of the present invention. The ball is divided into two hemispheres 11 and 12 divided by a dimple free equator E-E. A basic pattern section is shown on hemisphere 11. The pattern shows two different dimples 2 and 3 which will be described in detail below.

Figure 2:
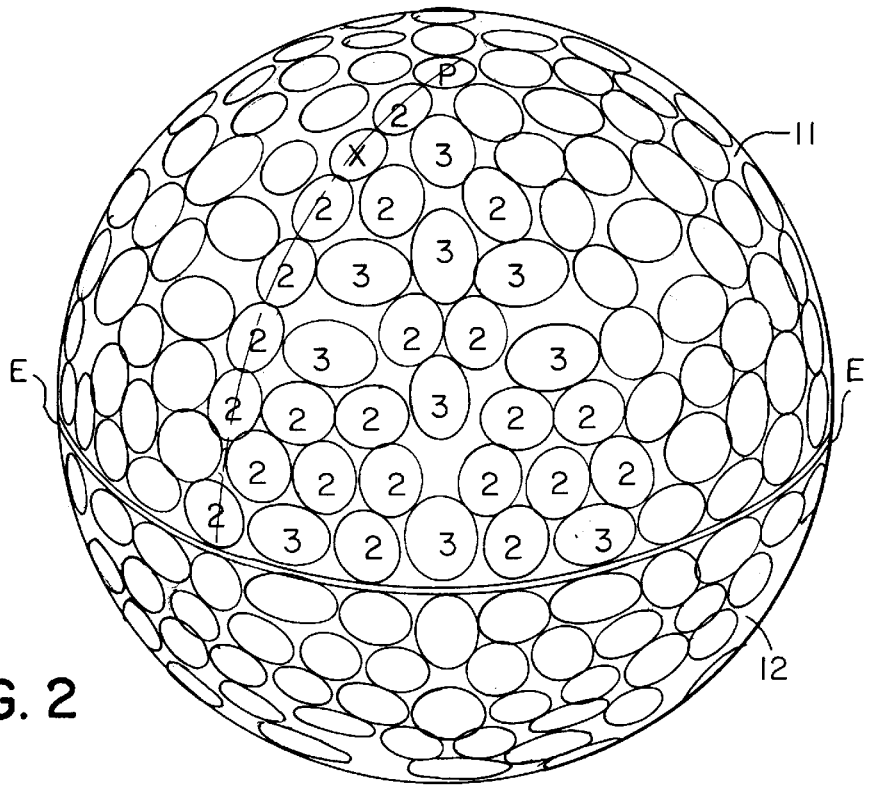
FIG. 2 is a perspective off equator view showing a finished ball incorporating the pattern of FIG. 1.

FIG. 2 is an off-equator view of a finished ball where substantially all of the dimples are dimples 2 and 3 as described above. As can be seen, a ball is provided which has substantially no dimple overlap. By creating dimples 2 by partial dimple drag as described above, it is possible to increase the percent dimple coverage over the coverage obtained using circular dimples in combination with elongated dimples 3 formed by full dimple drag since the surface area between dimples is reduced.

This pattern of FIG. 1 is repeated five times about the surface of hemisphere 11 except that all repeating patterns share a common pole dimple. This same pattern appears on hemisphere 12.

All of the elongated dimples 2 are substantially identical and all of the elongated dimples 3 are substantially identical. The specific configuration of these dimples is discussed below.

Dimples X are formed by the five core pins in each hemisphere which support the core within the mold while the cover is being formed. Due to the position of the core pins and the manner of their creation, dimples X are elliptical. The two polar dimples P are formed by vent pins during the formation of the cover and are substantially circular. Each key pattern includes 33 dimples plus the common pole dimple P which, when duplicated completely over the ball in the manner described above, results in a ball having a total of 332 dimples as shown in FIG. 2.

Figure 3:
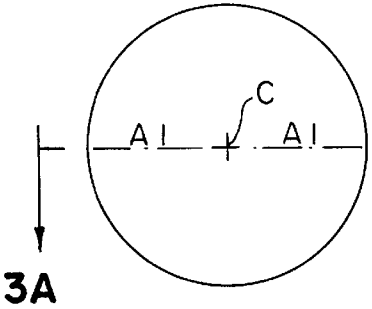
FIGS. 3 & 3A show a plan view and a cross-sectional view of a basic circular dimple.

FIGS. 3, 3A, 4, 4A, and 5, 5A illustrate the progression of dimple formation as used in the present invention. FIG. 3 is an illustration of a circular dimple as used on most golf ball surfaces at the present time. This dimple has a constant radius. Thus, the two axes A1 are equal. Arrow 20 indicates the initial direction of the drill which is used to form the dimple in 3A. The drill (not shown) extends into the spherical ball outer periphery at point C until the desired depth D1 is reached.

Figure 4:
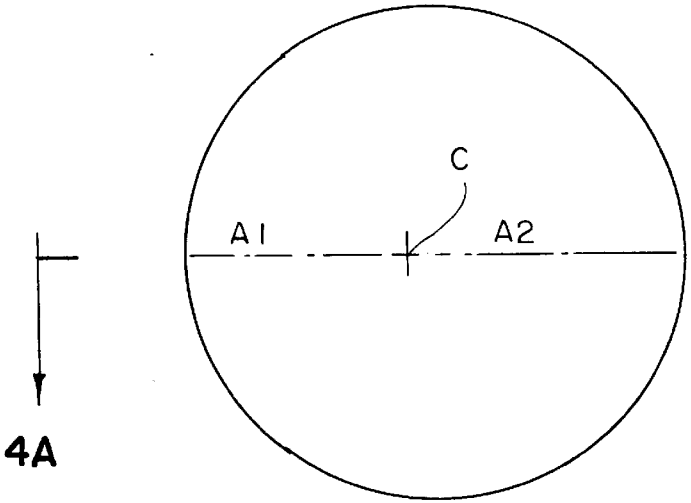
FIGS. 4 & 4A show a plan and cross-sectional view of an elongated dimple formed by having a partial dimple drag.

FIG. 4 illustrates dimple 2 of FIG. 1. Again the dimple is formed to the desired depth D2. Since the formation of this dimple starts with a circular dimple as in FIG. 3, the minor axis A1 is the same as the radius of the circular dimple. Dimple drag as discussed above, is in the direction indicated by arrow 15. In the illustration of FIG. 4, 4A partial dimple drag results in major axis A2 which is greater than axis A1.

FIG. 5 illustrates dimple 3 of FIG. 1 which has been formed using a full dimple drag. That is, the cutting drill is dragged until it leaves the curving surface of the ball. Again, since dimple 3 starts with a circular dimple, minor axis A1 is the same as minor axis A1 of FIG. 3. The full dimple drag produces an elongated dimple 3 having major axis A3 which is greater than axis A2 of elongated dimple 2.

Figure 4A:
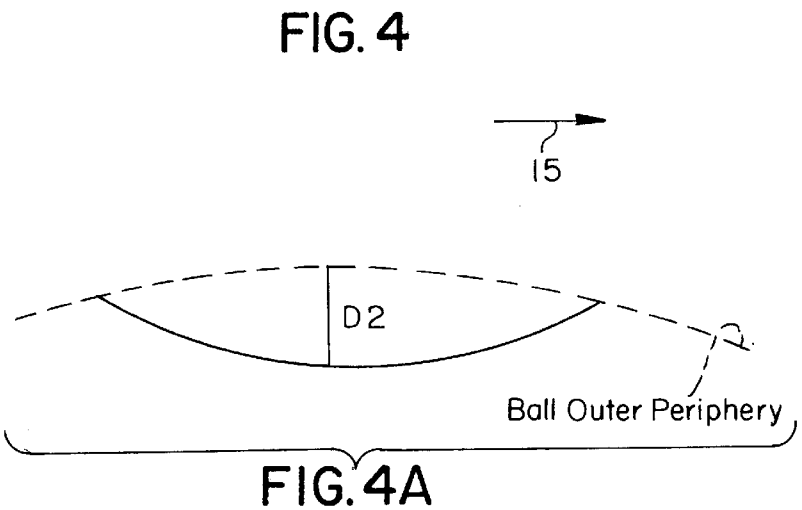
Figure 3A:
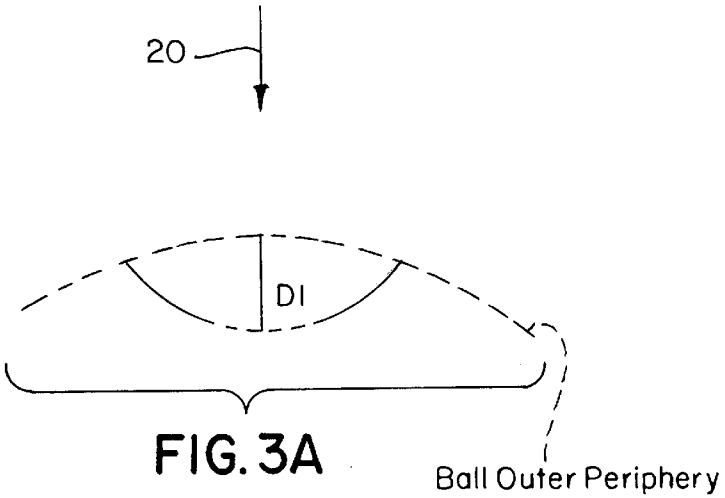

FIGS. 3A, 4A and 5A which are cross-sectional views taken along lines 3A, 4A, and 5A of FIGS. 3, 4, and 5 show the depth of the dimples of FIGS. 3, 4, and 5. The maximum depth D1, D2 and D3 occurs vertically below point C where the major and minor axes meet. Although varying depths may be selected, in the example below, all depths are equal. The selected depth is one of the parameters which controls the height of the trajectory of the ball.

EXAMPLE 1

One example of a specific ball, as shown in FIG. 2, is as follows. This ball has a total of 332 dimples with substantially all of the dimples having the configuration as shown in FIGS. 4, 4A and 5, 5A. The outside diameter of the ball is substantially 1.68 inches.

| Dimple | Minor Axis | Major Axis | Number of Dimples | Dimple Depth |
|---|---|---|---|---|
| 2 | 0.074 in. | 0.088 in. | 220 | 0.0117 in. |
| 3 | 0.074 in. | 0.140 in. | 100 | 0.0117 in. |

As discussed above, there are ten (10) elliptical core dimples and two (2) circular polar vent dimples. This dimple pattern results in a ball having a surface dimple coverage of substantially 77%.

Figure 6:
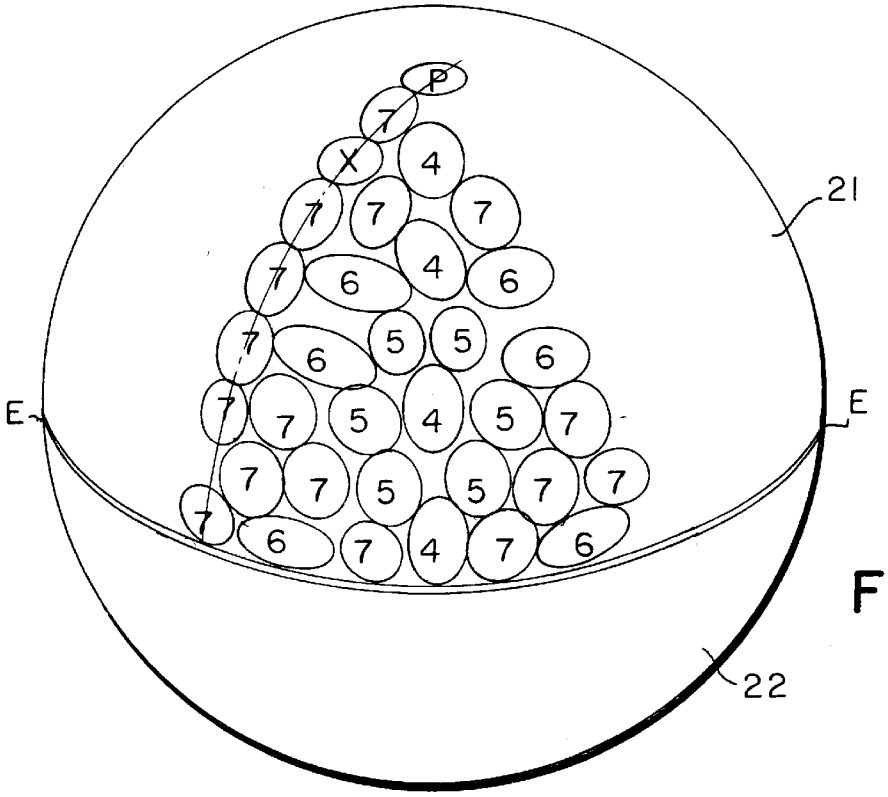
FIG. 6 is a perspective off-equator view showing a modified basic elongated dimple pattern section which is repeated about the surface of the ball.

FIG. 6 is a perspective off-equator view of a modified basic elongated dimple pattern which comprises four different sizes of elongate dimples 4, 5, 6, and 7. Elongated dimples 4 and 5 are formed starting with a dimple depression having the same diameter. Elongated dimples 6 and 7 are formed starting with a dimple depression having a different diameter than the dimple depression used for elongated dimples 4 and 5.

Using the basic illustrations of FIGS. 4 and 5 as applied to FIG. 6, dimples 4 and 5 have a minor axis A1. Dimple 4 has a full dimple drag resulting in a major axis A3. Dimple 5 has a partial dimple drag resulting in a major axis A2. As shown in FIGS. 7, 7A, 8, and 8A, dimples 6 and 7 have a minor axis A1'. Dimple 6 has a full dimple drag resulting in major axis A3'. Dimple 7 has a partial dimple drag resulting in a major axis A2'<A3. Thus dimples 4 and 5 have a minor axis A1 and dimples 6 and 7 have a minor axis A1'. Axis A1 differs from axis A1' since two different diameter dimple depressions are used. This forms a final pattern having four different size elongated dimples with substantially no dimple overlap wherein the sum of the major and minor axes differs in the four different elongated dimples. Again, the pattern of FIG. 6 is repeated in each hemisphere 21 and 22 so as to provide the finished ball as shown in FIG. 9.

EXAMPLE 2

Figure 9:
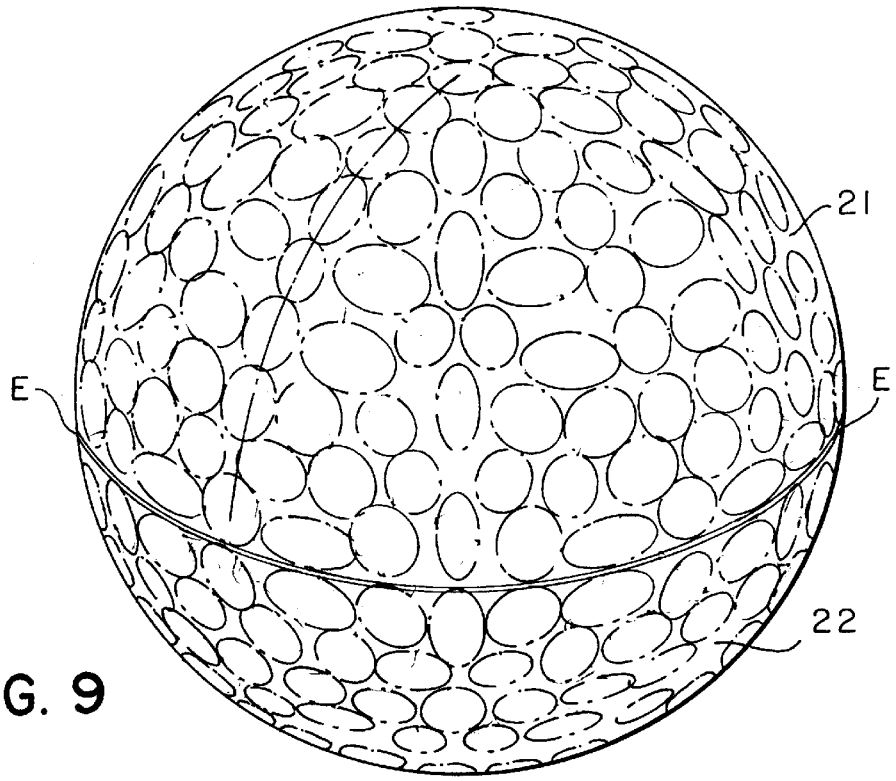
FIG. 9 is a perspective off-equator view showing a finished ball incorporating the pattern of FIG. 6.
Figure 8A:
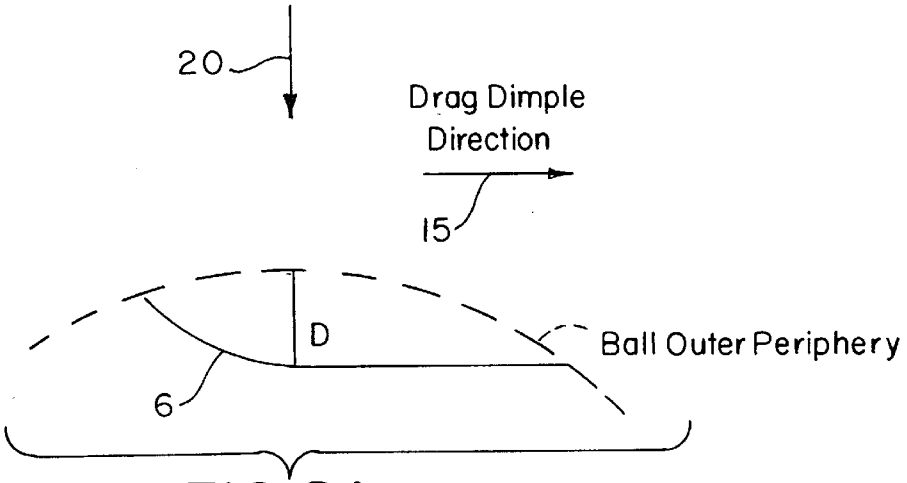
FIGS. 8 and 8A show a plan and cross-sectional view of a further elongated dimple formed by having a full dimple drag.
Figure 8:
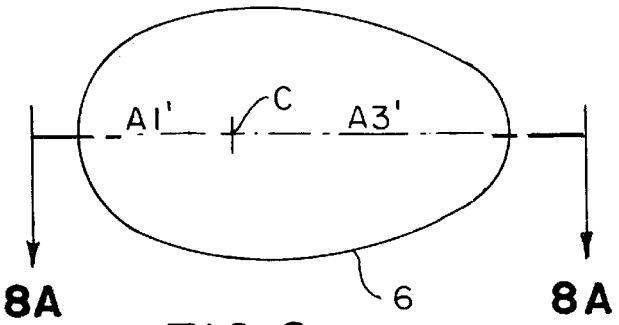

One example of a specific ball using the pattern of FIGS. 6 and 9 is as follows. This ball has a total of 332 dimples with substantially all of the dimples having an elongated configuration. This specific ball has an outside diameter of substantially 1.68 inches. Elongated dimples 4 and 6 are produced with a full dimple drag while dimples 5 and 7 are produced with a partial dimple drag. This ball provides a dimple coverage of substantially 75%.

| Dimple | Major Axis Length | Number of Dimples | Diameter | Depth |
|---|---|---|---|---|
| 4 Full | 0.1403 in. | 40 | 0.1400 in. | 0.0117 in. |
| 5 Partial | 0.0846 in. | 60 | 0.1400 in. | 0.0117 in. |
| 6 Full | 0.1403 in. | 60 | 0.1480 in. | 0.0117 in. |
| 7 Partial | 0.0880 in. | 160 | 0.1480 in. | 0.0117 in. |
| P & X Ellip/Cir | 0.0740 in. | 12 | 0.1480 in. | 0.0117 in. |

Figure 10:
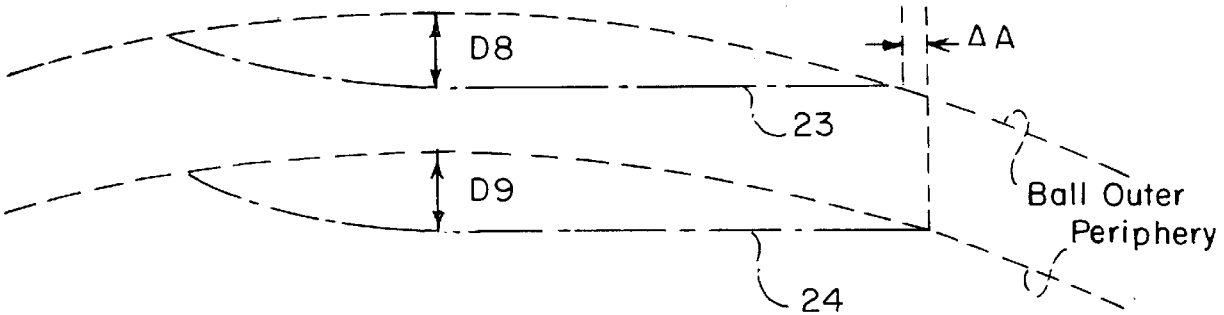
FIG. 10 is an enlarged cross-sectional view comparing dimples of different depths.

The selected depth of the original dimple depression is directly related to the length of the longitudinal axis of the elongated dimple resulting from dimple drag. This relationship is illustrated in FIG. 10 which shows an elongated view of the cross section of elongated dimples having different maximum depths. These dimples are produced with full dimple drag. Elongated dimple 23 has a maximum depth D8 which is less than the maximum depth of dimple D9 of dimple 24. This results in a difference ΔA in the total axis length of the two dimples.

Although the golf ball of the present invention could be produced by drilling each ball, such a procedure is not economically feasible. A procedure which has become standard in the industry is disclosed in U.S. Pat. No. 3,831,423 to Brown et al, issued Aug. 27, 1994. In this procedure, a hob is made of approximately the same dimensions as half of the finished golf ball and then a mold is formed from the hob.

The above description and drawings are to be considered illustrative since many dimple patterns could be created using a multiplicity of dimples having different dimple depression diameters and depths and different partial drag lengths without departing from the present invention, the scope of which is to be limited only by the following claims.

I claim:

1. A golf ball comprising:

(a) a spherical surface containing a pole in each hemisphere thereof and an equator midway between said poles; and (b) a plurality of non-overlapping dimples arranged in said surface in a pattern repeated five times within each hemisphere, said pattern including:

(1) a first plurality of elongated dimples having longer and shorter axes, said longer axis including a minor axis (A1) and a major axis (A3), said minor axis being less than said major axis; and (2) a second plurality of elongated dimples having longer and shorter axes, said last named longer axis including a minor axis and a major axis (A2) greater than said last named minor axis and less than said major axis (3) of said first plurality of dimples.

2. A golf ball as defined in claim 1, wherein said dimples cover at least 70% of said spherical surface.

3. A golf ball as defined in claim 2, wherein said minor axes of said first and second plurality of elongated dimples are equal.

4. A golf ball as defined in claim 3, wherein each of said dimples has a maximum depth aligned with the point at which said major and minor axes meet.

5. A golf ball as defined in claim 2, wherein said minor axes of said first and second plurality of elongated dimples are different.

6. A golf ball as defined in claim 5 wherein the maximum depth of said second plurality of elongated dimples is different than the maximum depth of said first plurality of dimples.

7. A golf ball as defined in claim 2, wherein said dimple pattern comprising four different sized elongated dimples.

8. A method of forming elongated dimples in a spherical surface, comprising the steps of:

(a) drilling into the surface in first direction along a radius of the surface to a first depth with a drill bit having a first radius;

(b) displacing the drill bit in a second direction normal to said first direction until it leaves the surface;

(c) repeating steps (a) and (b) to form a first plurality of elongated dimples;

(d) drilling into the surface in a third direction along a radius of the surface to a second depth with the drill bit;

(e) displacing the drill bit in a fourth direction normal to said first direction to a location short of a position where the drill bit would leave the surface;

(f) withdrawing the drill bit at said short location; and (g) repeating steps (d), (e), and (f) to form a second plurality of elongated dimples which do not overlap any of said first plurality of dimples.

* * * * *